US005755290A

United States Patent [19]

Crichton

[11] Patent Number: 5,755,290

[45] Date of Patent: May 26, 1998

[54] DOUBLE SWAB BARRIER AND METHOD FOR PRODUCING AND WIRELINE INTERVENING IN A PRODUCTION TREE

[75] Inventor: Wilson A. Crichton, Montrose, Scotland

[73] Assignee: ABB Vetco Gray Inc., Houston, Tex.

[21] Appl. No.: 781,156

[22] Filed: Jan. 8, 1997

[51] Int. Cl.[6] ..... E21B 33/03

[52] U.S. Cl. ..... 166/379; 166/75.13; 166/97.1

[58] Field of Search ..... 166/75.11, 75.13, 166/85.1, 97.1, 114, 192, 378, 379

[56] References Cited

U.S. PATENT DOCUMENTS

| | | | |
|---|---|---|---|
| 3,536,344 | 10/1970 | Nelson | 285/315 |
| 4,130,161 | 12/1978 | Jones | 166/337 |
| 5,000,719 | 3/1991 | Reed | 166/75.13 |
| 5,020,590 | 6/1991 | McLeod | 166/77.4 |
| 5,025,857 | 6/1991 | McLeod | 166/77.4 |
| 5,285,852 | 2/1994 | McLeod | 166/379 |

*Primary Examiner*—David J. Bagnell
*Attorney, Agent, or Firm*—James F. Bradley

[57] ABSTRACT

An additional barrier for a production tree works in conjunction with a conventional swab barrier. A spool with a bore is mounted on the tree above the swab valve. A tree cap is secured to the top of the spool. The spool has a nipple profile in its bore for receiving a multi-part retrievable plug. The plug is located across the junction between the tree cap and the tree and is wireline retrievable.

9 Claims, 1 Drawing Sheet

DOUBLE SWAB BARRIER AND METHOD FOR PRODUCING AND WIRELINE INTERVENING IN A PRODUCTION TREE

BACKGROUND OF THE INVENTION

This invention relates generally to an apparatus for use in oil and gas well servicing. More specifically, the invention relates to reducing the potential for high pressure blowouts during servicing.

A typical production tree in an oil or gas well has a swab valve in its bore. The swab valve is located above various production flow and annulus valves at an upper end of the bore. A tree cap is mounted above the swab valve on a spool. The tree cap can be removed for access to the bore for servicing the well. In the prior art, when a wireline or coiled tubing assembly was assembled on top of the spool, the swab valve would be closed until the pressure assembly or the coiled tubing lubricator was installed on the spool. The swab valve provides the only pressure barrier until the wireline or coiled tubing assembly is mounted on the spool.

SUMMARY OF THE INVENTION

This invention comprises an additional barrier for a production tree that works in conjunction with a conventional swab barrier. In the preferred embodiment, a spool with a bore is mounted on the tree above the swab valve. A tree cap is secured to the top of the spool. The spool has a nipple profile in its bore for receiving a multi-part retrievable plug, preferably, the plug is located across the junction between the tree cap and the tree and is wireline retrievable. Alternatively, the said nipple profile could be located in the bore above the swab valve, below the spool.

DETAILED DESCRIPTION OF THE INVENTION

Figure 1:
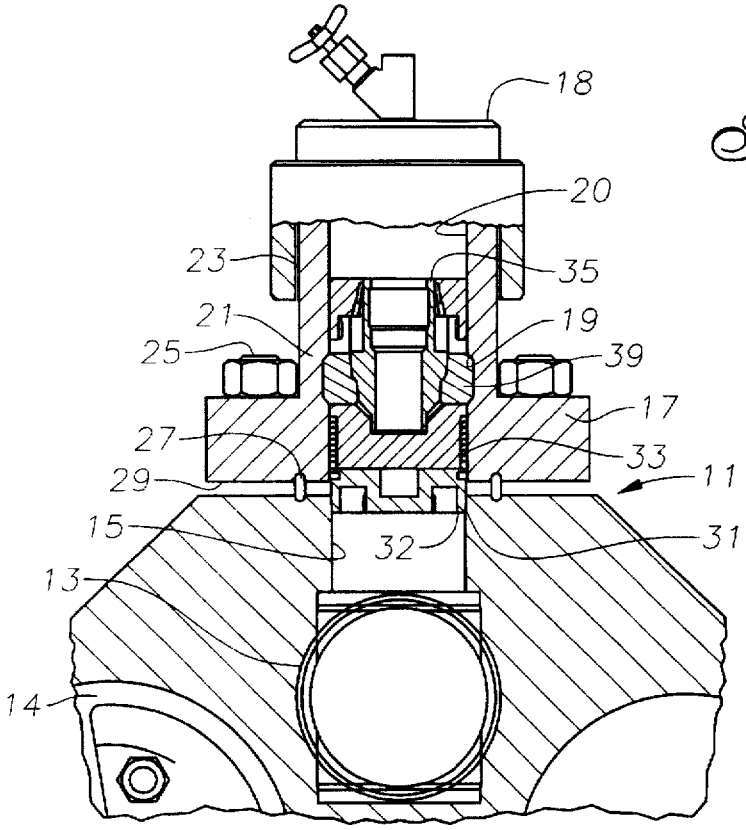
FIG. 1 is a sectional view of the upper end of a production tree constructed in accordance with the invention.
Figure 2:
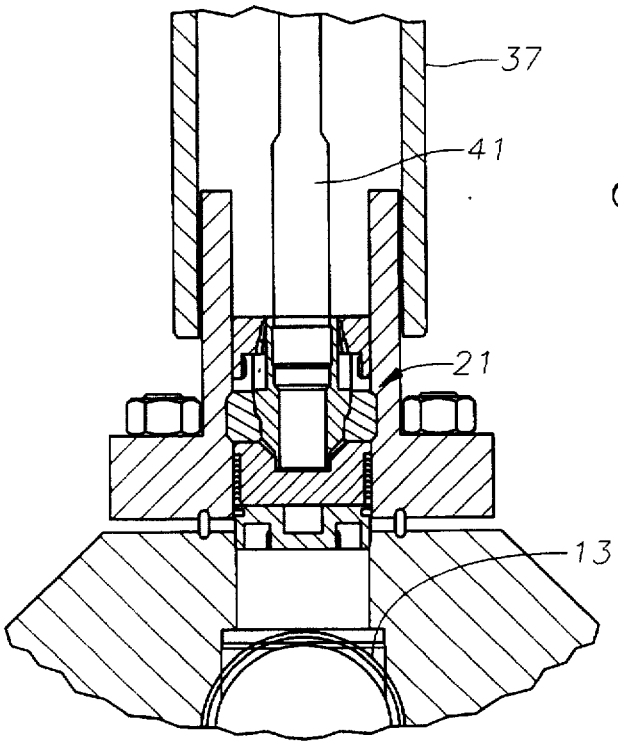
FIG. 2 is a schematic sectional view of a production tree during retrieval of the plug.

Referring to FIG. 1, an oil or gas production tree 11 with a vertical bore 15 is shown. Tree 11 has a conventional swab valve 13 mounted to its vertical bore 15. In the preferred embodiment, swab valve 13 is a gate valve. Swab valve 13 is located above production flow valve 14 and annulus valves (not shown) at an upper end of bore 15. A tree cap spool 17 with a vertical bore 20 is rigidly mounted on an upper end of swab valve 13 with a plurality of bolt assemblies 25. A circumferential metal seal 27 seals and provides a standoff or clearance 29 between spool 17 and tree 11. Seal 27 encircles vertical bore 15 and is seated in grooves in the lower flat face of spool 17 and the upper flat face of tree 11. A tree cap 18 is mounted on an upper end of spool 17. Tree cap 18 can be removed from spool 17 by unscrewing threads 23 for access to spool bore 20 and tree bore 15. Spool 17 also has a nipple profile 19 in its bore for receiving a multi-part retrievable plug 21. Ideally, nipple profile 19 should be at about the same level as the wing outlet valves (not shown). Referring to FIG. 2, plug 21 can be set and retrieved with a conventional wireline or otherwise conveyed tool 41 when tree cap 18 is removed and a riser 37 is installed on an upper end of spool 17. Plug 21 has a neck 35 which receives tool 41 and acts as a cam for lodging locking dogs 39 in profile 19. Plug 21 has a polished metal seal 31 at its lower end which seats against a tapered seat 32 in tree 11. Seat 32 is located at the upper end of bore 15. Plug 21 also has a circumferential elastomeric seal 33 that seals in bore 20 between plug 21 and spool 17 below profile 19.

In operation, tree cap 18 is secured to spool 17. Plug 21 is installed in bore 20, spanning the interface between tree 11 and spool 17. During normal production, swab valve 13 is closed and production flows out through production valve 14. For wireline or coiled tubing intervention, swab valve 13 is closed and tree cap 18 is removed. A wireline or coiled tubing riser 37 having a set of rams is installed on top of spool 17. Plug 21 remains in place while riser 37 is being installed, serving as an additional pressure barrier to swab valve 13. Plug 21 can be retrieved with a conventional wireline or otherwise conveyed tool 41 which passes through riser 37. The operator then places a tool or instrument in riser 37 and opens swab valve 13. After completion, the operator lowers the tool or instrument into the well and performs a desired operation without interrupting production.

The invention has significant advantages. It creates an inexpensive second barrier in addition to the swab valve of the tree. The second barrier avoids the risk of a blowout if the swab valve fails until the coiled tube or wireline riser is set up. Such an arrangement safely allows intervention equipment to be rigged-up on a live well.

Although the invention has been shown in only one of its embodiments, it should be evident to those skilled in the art that it is not so limited but is susceptible to various changes without departing from the scope of the invention.

I claim:

1. In a well production or injection tree having a vertical bore and a swab valve located in the bore, the improvement comprising:

a tree cap spool mounted to an upper end of the tree above the swab valve, the tree cap spool having a vertical passage coaxial with the vertical bore;

a seal located between the tree cap spool and the upper end of the tree;

a tree cap secured to the tree cap spool, the tree cap thereby closing the vertical passage of the tree cap spool; and a retrievable plug in the vertical passage of the spool.

2. The tree according to claim 1, further comprising a seal on a lower end of the plug for landing on and sealing with a tapered seat in the bore of the production tree above the swab valve.

3. The tree according to claim 1, further comprising a seal on the plug for sealing between the plug and the tree cap spool.

4. The tree according to claim 1 further comprising:

a lower seal on the plug which seats in the bore of the production tree; and an upper seal of the plug which seats in the vertical passage of the tree cap spool.

5. The tree according to claim 1 wherein the plug is wireline retrievable.

6. In a well production or injection tree having a vertical bore and a swab valve located in the bore, the improvement comprising in combination:

a tree cap spool mounted to an upper end of the tree above the swab valve, the tree cap spool having a vertical passage coaxial with the vertical bore, the tree cap spool having threads on an exterior side;

a seal located between the tree cap spool and the upper end of the tree;

a tree cap secured to the threads on the tree cap spool, the tree cap thereby closing the vertical passage of the tree cap spool;

a retrievable plug in the vertical passage of the spool, the plug spanning an interface between the spool and the production tree; and a metal seal on a lower end of the plug for landing on and sealing with a tapered seat in the bore of the production tree above the swab valve.

7. The well according to claim 6, further comprising a circumferential elastomeric seal on the plug for sealing to the vertical bore of the tree cap spool.

8. A method for producing well fluids from and wireline intervening in a production tree with a bore, a swab valve located in the bore, and a production valve below the bore, the method comprising:

securing and sealing a tree cap spool to an upper end of the production tree, the spool having a vertical passage aligned with the bore in the production tree;

landing and seating a plug in the vertical passage of the bore;

securing the tree cap on an upper end of a tree cap spool;

closing the swab valve;

opening the production valve and producing the well; then, to wireline intervene, removing the tree cap from the tree cap spool;

securing a riser to the upper end of the tree cap spool;

retrieving the plug through the riser; then opening the swab valve and lowering a tool through the riser, vertical passage of the spool and bore of the tree into the well.

9. The method according to claim 8, further comprising:

sealing a lower portion of the plug in the bore of the production tree; and sealing an upper portion of the plug in the vertical passage of the tree cap spool.

* * * * *